United States Patent [19]

Lange et al.

[11] 4,123,682

[45] Oct. 31, 1978

[54] COLD CATHODE GAS-DISCHARGE TUBE

[75] Inventors: Gerhard Lange; Gerhard Peche, both of Berlin, Germany

[73] Assignee: Siemens Aktiengesellschaft, Berlin & Munich, Germany

[21] Appl. No.: 610,927

[22] Filed: Sep. 8, 1975

[30] Foreign Application Priority Data

Sep. 20, 1974 [DE] Fed. Rep. of Germany ..... 2445063

[51] Int. Cl.[2] ..... H01J 17/00

[52] U.S. Cl. ..... 313/54; 313/217

[58] Field of Search ..... 313/54, 217, 325

[56] References Cited

U.S. PATENT DOCUMENTS

| | | | |
|---|---|---|---|
| 1,650,921 | 11/1927 | Winkelmann | 313/54 |
| 3,811,064 | 5/1974 | Kawiecki | 313/325 |
| 3,904,910 | 9/1975 | Schleimann-Jensen | 313/325 |

*Primary Examiner*—Rudolph V. Rolinec
*Assistant Examiner*—Darwin R. Hostetter
*Attorney, Agent, or Firm*—Hill, Gross, Simpson, Van Santen, Steadman, Chiara & Simpson

[57] ABSTRACT

A gas-discharge tube especially adapted for use as an over-voltage arrestor containing a radioactive material for pre-ionizing the gas filling is provided in which a radioactive material is applied to at least a portion of the surface of a pair of spaced electrodes located in the tube.

3 Claims, 4 Drawing Figures

COLD CATHODE GAS-DISCHARGE TUBE

FIELD OF THE INVENTION

This invention relates to cold cathode gas-discharge tubes which are especially suitable for use as over voltage arrestors. Electrodes are mounted in the gas filled discharge container opposite one another at a distance, and the container contains a radioactive material for pre-ionization of its gas filling.

BACKGROUND OF THE INVENTION

In order to avoid ignition delays in the case of gas-discharge tubes, and particularly in the case of gas-discharge tubes used as over voltage arrestors, it is known in the art to have a radioactive material in the container in order to pre-ionize the gas filling. See German Pat. No. 615,506. It is also known to apply a ring-shaped tape of Nickel 63 on the inner surface of a tubular insulator member in the area between the electrodes, in order to pre-ionize the gas filling, which consists, for instance, of argon or helium. Krypton 85 has also been disclosed in the past for the pre-ionization. See Auslegeschrift No. 1,188,708.

It has also been suggested in the past to apply a radioactive fixed-member such as Promethium 147 on the tubular insulator member of over voltage arrestors, having magnesium oxide or glass solder as carrier substance.

The prior art gas-discharge tubes, and in particular, over voltage arrestors, which include a radioactive specimen for pre-ionizing the gas filling, have the drawback that the production cost of these tubes is relatively high. The extent of these costs is due to the safety measures when handling radioactive specimens, which are required, and the high price of these specimens. Furthermore, the prior art over voltage arrestors with radioactive specimens in their discharge chamber have the drawback that the electric function of these component elements is not always exact, due to the lack of reproducability of the fabrication system, and thus the reaction voltage.

BRIEF SUMMARY OF THE INVENTION

It is an object of the present invention to avoid these drawbacks in the case of gas-discharge tubes. Specifically, the present invention provides a cold gas-discharge tube of the initially mentioned kind by applying the radioactive material on at least a portion of the surfaces of the electrodes. The radioactive material is preferably mixed into an activation mass applied to the electrodes.

As previously mentioned, Nickel 63 is known as a suitable pre-ionization material. Since Nickel 63 is comparatively very expensive, it can only be inserted into arrestors with minor activities, for price reasons. It is thus proven advantageous to activate Nickel powder having a grain size of approximately 8μm with Nickel 63 and to mix this into the electrode activation mass. The particular advantage consists in the fact that the radioactive radiator is arranged in the gas-discharge tube in an optimally effective location.

BRIEF DESCRIPTION OF THE DRAWINGS

Four embodiments of the invention are illustrated in the four figures of the drawings.

DESCRIPTION OF THE PREFERRED EMBODIMENTS

Figure 1:
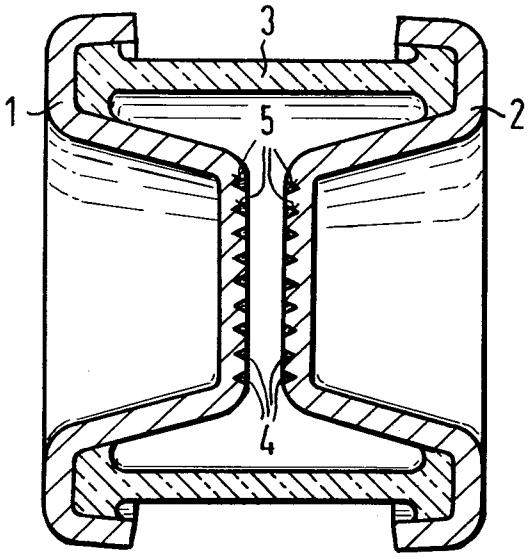
FIGS. 1, 3 and 4 are sectional views of cold cathode gas-discharge tubes made in accordance with the invention, and which are of the over voltage knob type.

The over voltage arrestor shown in FIG. 1 comprises a tubular insulator member 3 formed of glass. The frustum-shaped electrodes 1, 2 are inserted into the ends of the tubular insulator member 3, and in gas tight relation therewith. Their arches are turned towards one another. Over voltage arrestors of this kind are often called knob arrestors, due to their specific shape. The active surfaces of the electrodes 1, 2, which face one another, are provided with a waffle-type recess 5. The electrode activation mass, i.e., a mass made of a material of high electron-emission-ability containing a radioactive material 4, preferably nickel powder with Nickel 63, is inserted into the recesses 5.

Figure 2:
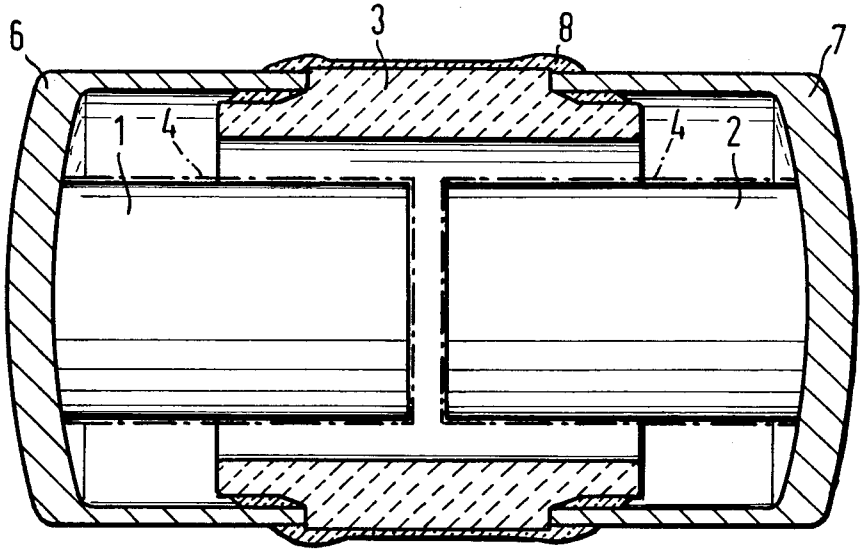
FIG. 2 is a view, partly is section, of another preferred embodiment of a cold cathode gas-discharge tube in accordance with the invention, and which is in the form of an over voltage arrestor.

FIG. 2 shows another embodiment of an over voltage arrestor embodying the present invention. The gas-tight housing of the arrestor is formed by two electrode caps 6, 7 which are glazed as at 8 to a ceramic insulator member 3. Two massive-cylindrical electrodes 1, 2 are arranged opposite one another in the interior of the housing. The electrode 1 is attached to the electrode cap 6, and the electrode 2 to the electrode cap 7. The electrodes 1, 2 are provided with a coating which includes a radioactive material, preferably a nickel 63 coating.

Figure 3:
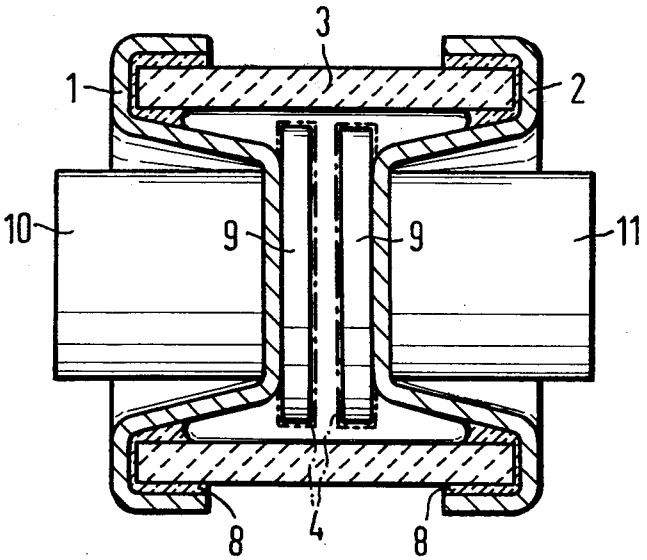

FIG. 3 shows a further embodiment of an over voltage arrestor embodying the present invention and is in the form of a knob arrestor. The frustum-shaped electrodes 1, 2 are mounted in a gas-tight manner in the ends of a tubular insulator member 3 consisting of a ceramic, by means of a glass layer 8. In the case of this arrestor, two massive metal studs 10 and 11, respectively, serve as feed lines which are attached to the bottom surface of the two frustum-shaped electrodes 1 or 2, respectively. The surfaces of the electrodes 1, 2 which are turned towards one another, are respectively provided with a massive metal disc 9, which forms the active electrode surface, and which are provided with a coating made of a radioactive material 4 on its surface, preferably a nickel 63 coating.

The over voltage arrestor shown in FIG. 4 is again a so-called knob arrestor. The frustum-shaped arched electrodes 1, 2 are turned towards one another with their archings and are mounted in a gas-tight manner in the ends of a tubular insulator member 3 made of glass. A metallic ring 13 is respectively mounted on each of the two archings of the electrodes 1, 2 which are turned towards one another. The active surfaces of the electrodes 1, 2 form hollow electrodes into which an electrode-activation mass is applied. In the case of this embodiment, the two metallic rings 13 of the hollow electrodes are provided with a coating made of a radioactive material 4 such as a nickel 63 coating.

Figure 4:
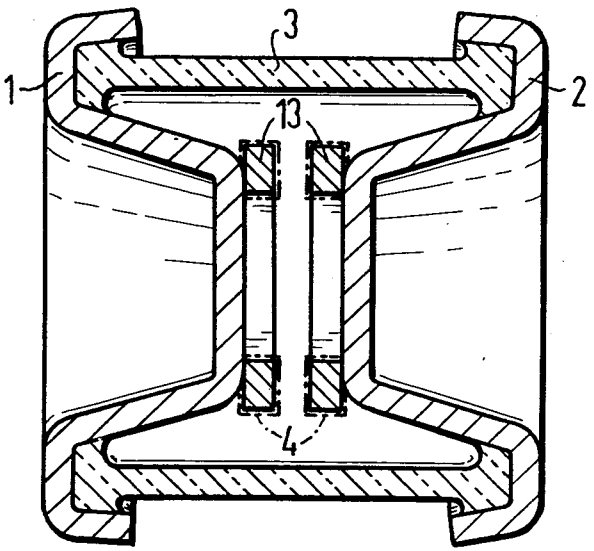

The coating made of a radioactive material may be obtained in the embodiments shown in FIGS. 2 through 4 in an advantageous manner in such a way that either a galvanic layer is applied onto the finished electrodes, or the electrodes are punched from a sheet strip having a coating consisting preferably of nickel 63, which was applied on one side.

It will be apparent to those skilled in the art that many modifications and variations may be effected without departing from the spirit and scope of the novel concepts of the present invention.

We claim as our invention:

1. A surge voltage arrestor comprising:

a gas-tight electrical insulating housing;

an ionizable gas in said housing;

a pair of spaced apart electrodes symmetrically mounted in said gas-tight housing with their frontal surfaces facing each other;

a preparation of nickel power containing Nickel 63 radioactive material for pre-ionizing said gas;

said radioactive material being adhered to at least a portion of the surface of both of said electrodes; and said nickel powder having a grain size of approximately 8 μm.

2. A cold cathode gas-discharge tube according to claim 1, in which said radioactive material is mixed into an electrode activation mass.

3. A surge voltage arrestor comprising:

a gas-filled discharge receptacle having a pair of electrodes disposed therein;

said electrodes being spaced apart and facing each other;

said electrodes having an electrode activation compound disposed thereon;

said electrode activation compound being a radioactive material for the preionization of gas within the receptacle, said radioactive material consisting of nickel powder which contains Nickel 63; and said nickel powder having a grain size of approximately 8 μm.

* * * * *